United States Patent [19]

Bruce

[11] Patent Number: 4,856,451

[45] Date of Patent: Aug. 15, 1989

[54] FLUKED BURIAL DEVICES

[75] Inventor: Peter Bruce, Onchan, United Kingdom

[73] Assignee: Brupat Limited, Onchan, United Kingdom

[21] Appl. No.: 123,911

[22] Filed: Nov. 20, 1987

Related U.S. Application Data

[63] Continuation-in-part of Ser. No. 822,308, Dec. 31, 1985, abandoned.

[30] Foreign Application Priority Data

May 5, 1984 [GB] United Kingdom ..... 8411595
Feb. 20, 1985 [GB] United Kingdom ..... 8504402

[51] Int. Cl.[4] ..... B63B 21/26; B63B 21/32; B63B 21/40

[52] U.S. Cl. ..... 114/301; 114/304; 114/310

[58] Field of Search ..... 114/294, 301, 304, 309, 114/310

[56] References Cited

U.S. PATENT DOCUMENTS 2,103,477 12/1937 Lucking ..... 114/301
2,368,942 2/1945 Northrop ..... 114/306
2,630,774 3/1953 Polenz ..... 114/309 X
3,022,761 2/1962 Beixedon ..... 114/306
3,505,969 4/1970 Bowers ..... 114/304
4,154,187 5/1979 Taylor .

FOREIGN PATENT DOCUMENTS 322075 10/1934 Italy .
2035242 6/1980 United Kingdom ..... 114/301
2091188 7/1982 United Kingdom .

*Primary Examiner*—Sherman D. Basinger
*Attorney, Agent, or Firm*—Mason, Fenwick & Lawrence

[57] ABSTRACT

A marine anchor comprises a fluke with a shank attached to the fluke to enable the anchor to be joined to an anchor cable. Additionally there is provided a soil barrier plate located aft of the rear of the fluke but above the level of the fluke, with a soil passage between the barrier plate and the fluke. The barrier plate is set an angle to the fluke, and the barrier plate and the associated soil passage are arranged so as to function in a manner enabling the anchor to operate effectively and without adjustment in cohesive soils such as mud even when the fluke is set (say at an attack angle 0° of 30°) for optimum operation in non-cohesive soils such as sand, without substantially detracting from the performance of the anchor in non-cohesive (sand) soils.

22 Claims, 5 Drawing Sheets

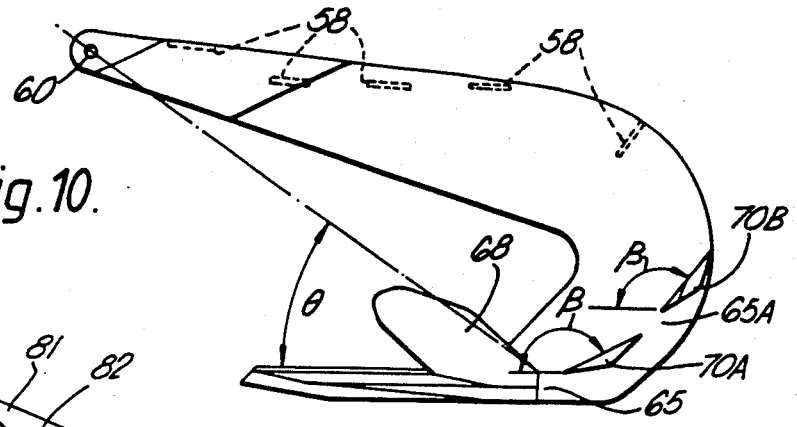
Fig. 10.
Fig. 11.
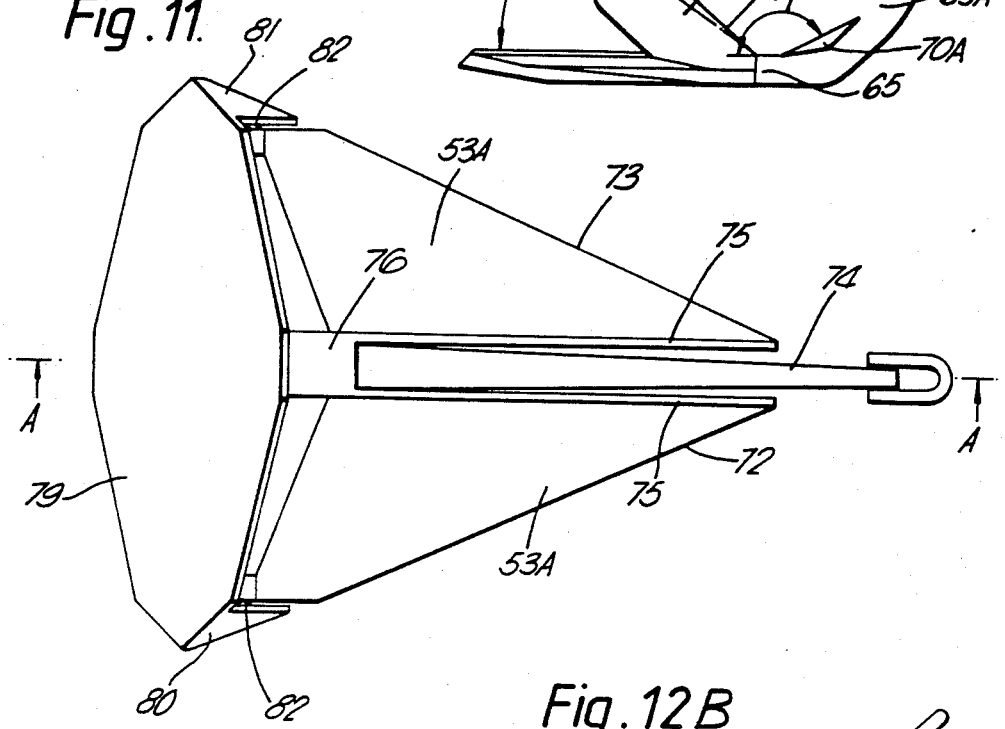
Fig. 12B
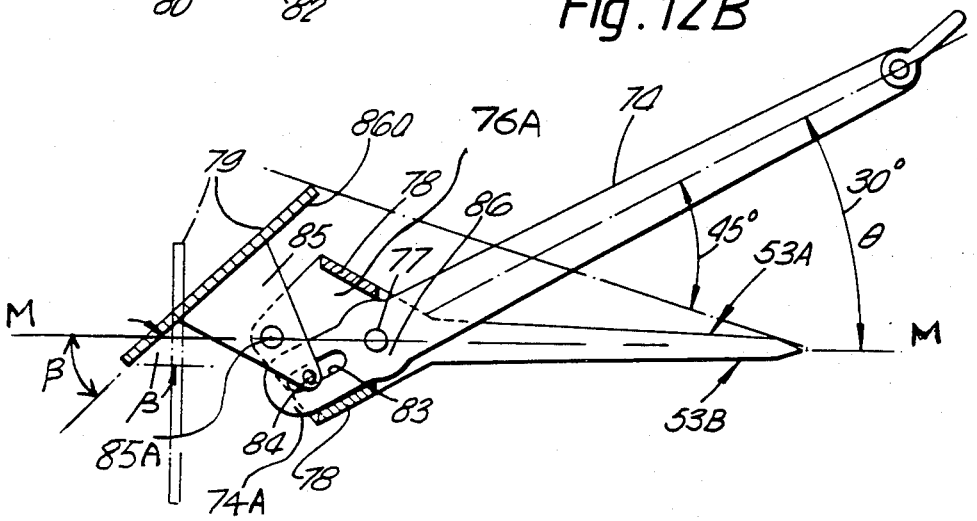

FLUKED BURIAL DEVICES

PRIOR RELATED APPLICATIONS

The present application is a continuation-in-part of application Ser. No. 822,308 filed Dec. 31, 1985, now abandoned.

BACKGROUND OF THE INVENTION

The present invention relates to fluked burial devices adapted for burying into a soil and more particularly to marine anchors, cable depressors and such-like fluked devices adapted for burying into submerged soil.

A marine anchor comprising a shank with a cable attachment point at the forward end and a fluke structure attached thereto has a fluke angle $\theta$ defined by the angle between the fore-and-aft central line of the fluke structure and the line from the said cable attachment point to the rear of the fluke structure measured in the vertical plane of symmetry. Up until now, this angle $\theta$ has been in the range 28° to 50° with the anchor embedded in the soil. Fluke angles in the range 28° to 35° have generally been found to give optimum anchor performance in granular non-cohesive soils such as sand and gravel, since this relatively low fluke angle enables the anchor fluke more readily to penetrate the firmer soils formed of sand or gravel. On the other hand a fluke angle of approximately 50° has been found necessary to give optimum performance in cohesive soils such as soft clay and mud. This is due to the fact that in such cohesive soils as mud, the forward end of the shank of the anchor tends to tilt upwardly when the anchor is in the fully buried condition thereby seriously reducing the actual or effective angle of attack of the fluke. Provision of the relatively high fluke angle of 50° enables this operational disadvantage to be substantially overcome and satisfactory anchor holding force maintained.

For ship use, anchors usually have a fluke angle in the region of 40° to provide a reasonable compromise performance when used in either non-cohesive or cohesive soils. For offshore drilling vessels or pipelaying barges using multiple anchor spread moorings, anchors generally have means for adjusting the fluke angle to give optimum performance according to the soil type in which the anchors are deployed. Unfortunately, the nature of the mooring bed soil often is unknown prior to deploying anchors and several anchors may be deployed before it is realised that incorrect fluke angles have been selected. These anchors must then be retrieved for fluke angle adjustment and redeployed. This wastes time and consequently incurs high costs.

It is an object of the present invention to obviate or mitigate these disadvantages.

According to one aspect of the present invention there is provided a fluke burial device, particularly an anchor having a burial fluke member orientated to provide a positive burial angle for digging into a bed of soil when the burial device is in the vertical working burial attitude, a cable attachment member attached to said fluke member, soil barrier means located substantially above the burial fluke member when the burial device is in said vertical working burial attitude such that a straight line from a foremost extremity of the fluke member to an upper edge of the soil barrier means lies in the range 8° to 24° to the upper surface of the fluke member, a major portion of the soil barrier means being located aft of the rear edge of the burial fluke member and such that the rear of the soil barrier means has a horizontal separation from the rear of the burial fluke member not more than half the overall longitudinal length of the fluke member, said soil barrier means including at least one soil barrier surface which is inclined relative to said fluke member, said soil barrier surface having an area less than the upper surface area of the fluke member, and passage means associated with said soil barrier means to permit escape of non-cohesive soil passing over the fluke member.

According to another aspect of the present invention there is provided a fluke burial device, particularly an anchor having a burial fluke member orientated to provide a positive burial angle for digging into a bed of soil when the burial device is in the vertical working burial altitude, a cable attachment member attached to said fluke member, soil barrier means located substantially above the burial fluke member when the burial device is in said vertical working burial altitude, the major portion of the soil barrier means being located aft of the rear edge of the burial fluke member and such that the rear of the soil barrier means has a horizontal separation from the rear of the burial fluke member not more than half the overall longitudinal length of the fluke member, said soil barrier means including at least one soil barrier surface which is inclined with a forwardly opening acute angle relative to said burial fluke member, said soil barrier surface having an area less than the upper surface area of the fluke member, and soil passage means associated with said soil barrier means to permit escape of non-cohesive soil passing over the fluke member.

BRIEF DESCRIPTION OF THE FIGURES

Embodiments of the present invention will now be described by way of example with reference to the accompanying drawings wherein:

FIG. 10 shows a further embodiment FIG. 11 shows a plan view of a marine anchor according to a fourth embodiment of the present invention.

FIGS. 12A and 12B show sectional side views of the anchor of FIG. 11 through section A—A in FIG. 11 for the anchor in the closed non-operative position and in the open operating position respectively.

DETAILED DESCRIPTION OF A PREFERRED EMBODIMENT

Figure 1:
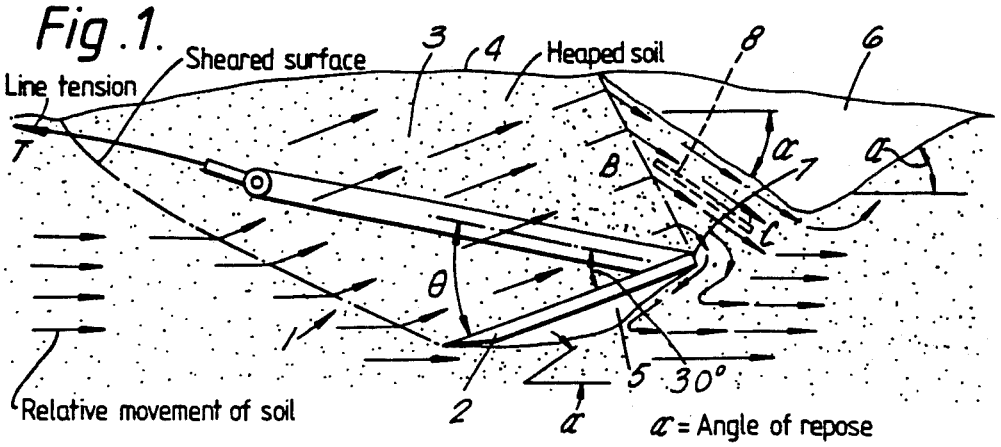
FIGS. 1 to 3 show side views of a basic anchor type in operational modes providing an explanation to a theoretical background to the present invention.
Figure 2:
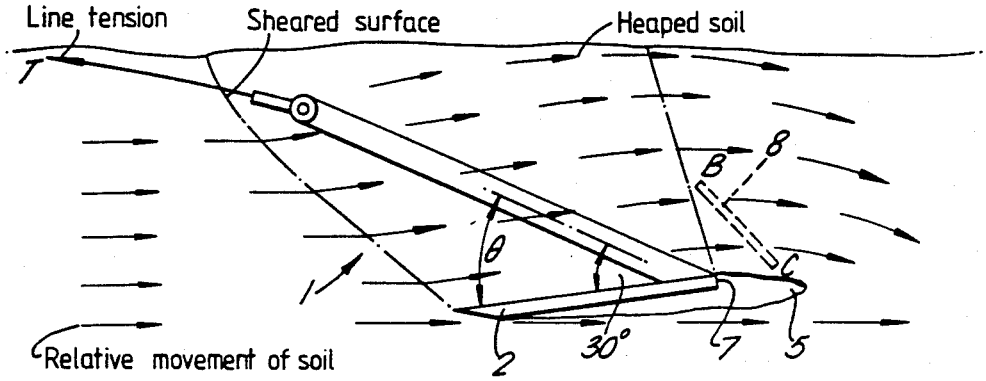
Figure 3:
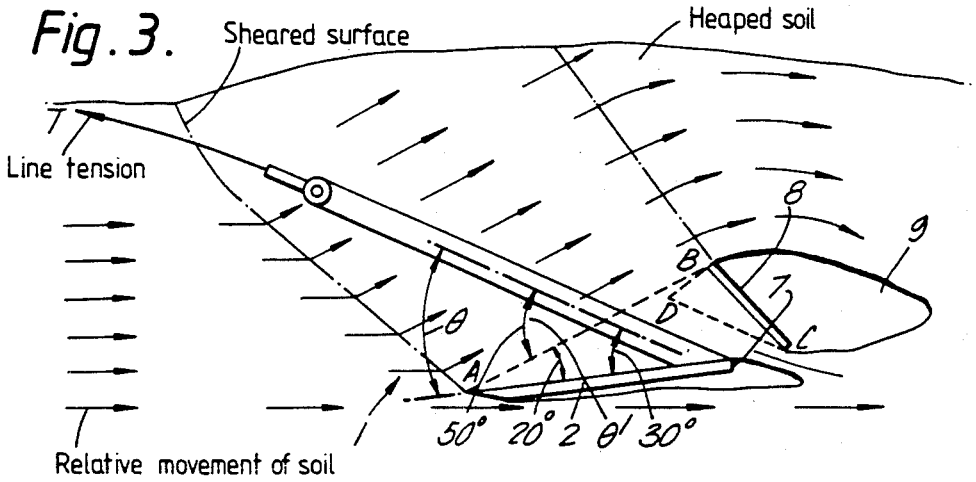

FIGS. 1 to 3 show anchors in an operative position which is hereinafter and in the claims referred to as "the vertical working burial attitude". In this attitude the central symmetry plane of the anchor (i.e. the plane CP of FIG. 5) which extends normally from the fluke and on either side of which plane CP the anchor is symmetrical, is arranged vertically, and the anchor is orientated in this vertical plane so that the fluke is capable of digging into the mooring bed soil, the cable attachment end of the shank and the toe of the fluke occupying forward positions.

With reference to FIG. 1, an inclined anchor fluke 2 of a shallow buried anchor 1 moving horizontally in non-cohesive soil 3 such as sand causes the sand to move relative to the anchor upwards and parallel to the fluke into a heap 4 over the fluke whilst a void 5 tends to form under the fluke 2 and a depression 6 forms in the sand aft of the heap 4. The depression 6 has forward and after slopes each inclined at an angle of repose of the sand which is approximately equal to the angle of internal friction of the sand in a loose state, ranging from 28° to 34°, and is the angle to the horizontal of the slope of a heap produced by pouring sand from a small height onto a horizontal plane. Displaced sand, which has passed through the heap over the anchor fluke 2, continuously slides down the rear slope of the heap and over the rear edge 7 of the fluke 2 to fall into the void 5 below in which it slides down another slope at the angle of repose prior to making an exit aft by relatively moving in a direction opposite to the movement of the anchor. The direction of relative movement of sand in the region above and aft of the fluke 2 is thus inclined at an angle to the fluke in the range 38° to 64° for anchor attitudes giving fluke inclinations to the horizontal in the range 10° to 30°. A barrier plate 8 located at BC parallel to the local direction of relative sand flow should not disrupt the sand flow pattern and should not, therefore, inhibit optimal performance of the anchor in non-cohesive soil.

When the anchor fluke becomes more deeply buried in non-cohesive soil, soil pressure from the rear slope of the depression 6 alters the direction of sand flow off the heap 4 along the angle of repose until ultimately a vertical funnel or 'pipe' forms from the bottom of the depression to the rear of the anchor fluke. Displaced loose sand falls down this pipe into the transient void 5 beneath the inclined moving fluke 2 before relatively flowing away aft in the direction opposite to that of anchor movement. The angle of the barrier plate 8 may therefore be required to be angled as much as 120° to the fluke to remain edge-on to sand flow in the 'pipe' at the rear of the fluke 2. In practice, the pipe of falling loose sand will bend round to follow the inclination of the barrier plate 8 with the result that a smaller angle between plate and fluke more suitable for minimum flow disturbance at shallow burial depth is satisfactory even for deep burial.

With reference to FIG. 2, the anchor of FIG. 1, having a fluke angle $\theta$ of 30°, adopts a much smaller fluke inclination to the horizontal (i.e. actual angle of attack) when moving in cohesive soil such as mud. The cohesion of the soil prevents it from cascading into the underfluke void 5 which in consequence, streams out behind the fluke. No abrupt change in relative soil flow direction occurs as soil moves into the region immediately aft of the fluke. A barrier plate 8 in this region, located at BC as before, would be substantially athwart the direction of relative soil flow and would therefore greatly disrupt the flow pattern.

The overall change in the relative flow pattern of mud brought about by a barrier 8 at location BC is shown in FIG. 3. On entering the soil, mud flows initially parallel to the fluke upper surface until a stalled wedge of mud accumulates on the forward face of the barrier plate 8 as indicated in section by the dashed triangle BCD. The fluke upper surface and face DC of the stalled mud wedge together form a rapidly converging passage constituting a choke gap having high resistance to mud flow therethrough. This high resistance to flow induces additional mud to dwell over the fluke upper surface whereby a dynamically stable and much larger mud wedge ABC forms. This large mud wedge effectively moves with the fluke (although some mud may flow slowly through the choke gap) and serves to increase the fluke angle from the 30° optimum for sand to the desired 50° optimum for mud by inducing shearing of the mud along line AB at 20° to the fluke upper surface. Additionally, deflection of mud relative flow by the wedge ABC over the barrier greatly increases the size of the void 9 and so increases the suction contribution to horizontal load in the anchor line.

The barrier may be perforated with holes or slots allowing even more mud to pass through the barrier but, due to the retardation of mud flow in zone ADC, a dynamically stable wedge ABC remains with shearing of the mud still occurring along line AB and producing the desired increase in effective fluke angle $\theta$ from 30° to 50° ($\theta^1$). Such a perforated barrier is advantageous for a hinged fluke anchor to permit ultimate escape aft of non-cohesive soil falling into the under-fluke void which otherwise would be prevented from relatively flowing aft out of the void since the barrier would require to be symmetrical about the plane of the fluke.

Figure 5:
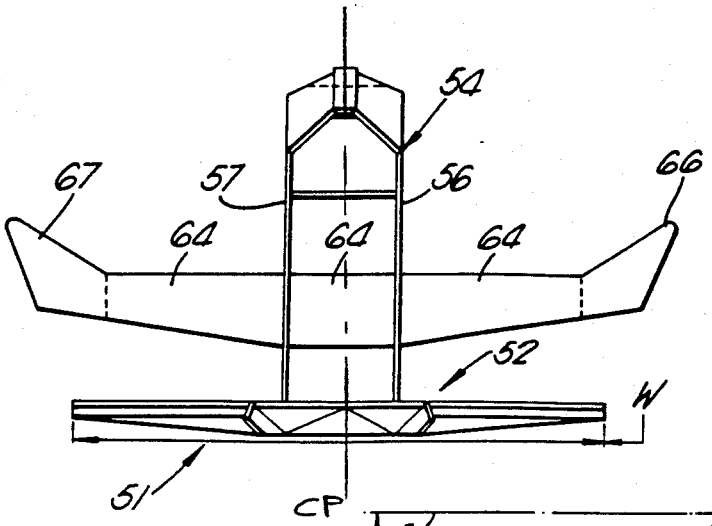
FIGS. 4,5 and 6 show a side view, a front view and a plan view of an anchor in accordance with a first practical embodiment of the present invention.
Figure 6:
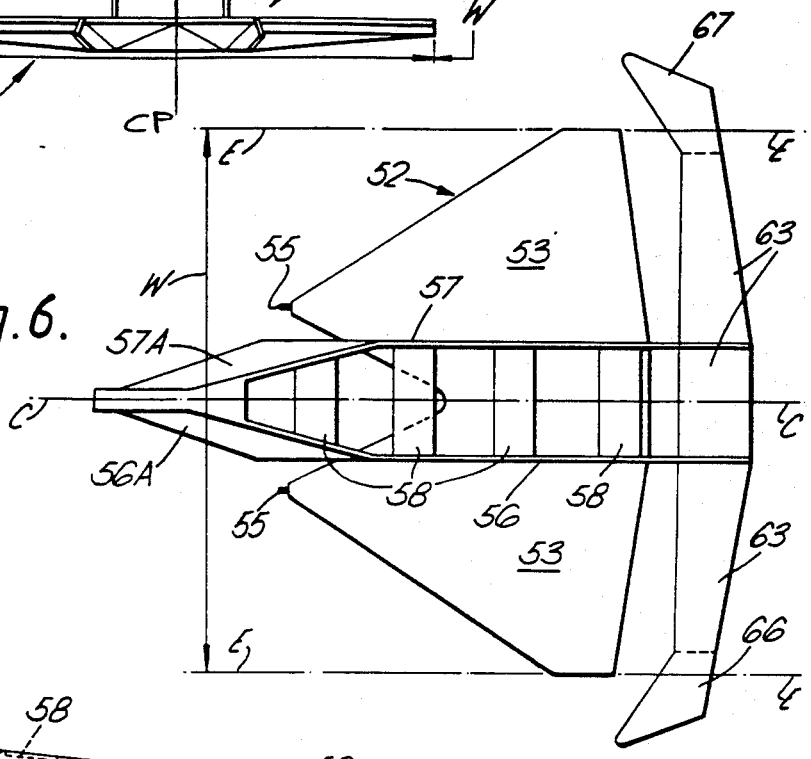
Figure 4:
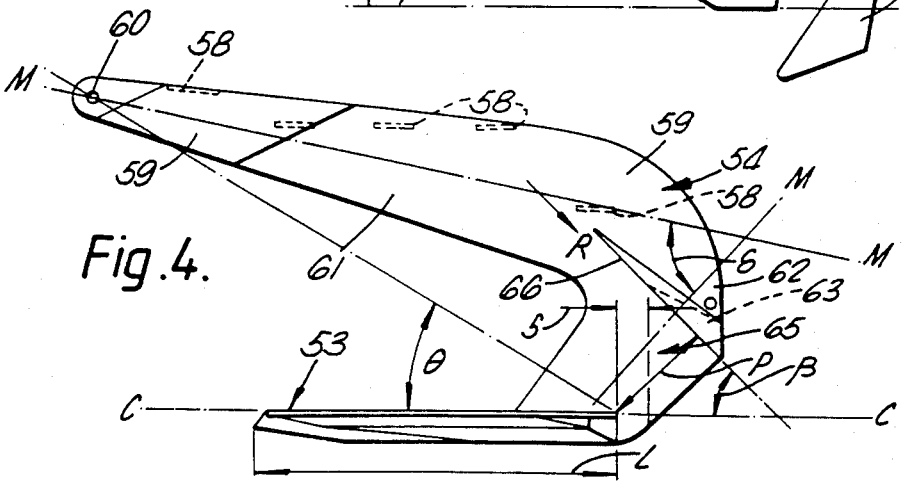

Referring to FIGS. 4 to 6, a marine anchor 51 comprises a fabricated hollow fluke 52 having a substantially planar upper surface 53, and a cranked form shank 54 attached to the rear of the fluke 52. The fluke 52 is of double-toed form (55) and has a width W greater than the overall longitudinal length L of the fluke 52 (by for example 50% approximately), the length L being the distance between the front and rear extremities of the fluke 52, while the shank 54 has double legs 56, 57 and is in accordance with the applicant's European Patent 0020152. The shank 54 includes transverse strengthening plates 58 and these together with fluke surface 53 form non-converging open ended passages 59 in the shank; the legs 56, 57 include forward inclined burial portions 56A, 57A while a cable attachment hole 60 is at the forward end of the shank. The legs 56, 57 are of cranked form presenting leg portions 61, 62 and a feature of the present shank arrangement is that the medial lines M of these leg portions intersect with an acute angle S so that the back of the shank 54 projects rearwardly from the rear of the fluke 52.

The fluke 52 is set at an angle $\theta$ of approximately 30. For the purpose of maintaining an effective fluke angle of attack (or alternatively satisfactory fluke forwardly projected area) when the anchor is burying in soft cohesive soils, e.g. soft mud, a soil barrier member 63 is carried by the leg portions 62 of the shank and extends transversely relative to the fluke centre line C—C and has a width approximately 28% of the fluke length L. The barrier can have a working area of 10% to 65% of the fluke area, and preferably 20% to 50% of the fluke area. The barrier member 63 can be of steel fabricated hollow construction with a triangular cross section, and in this embodiment the leading (working) surface 64 is inclined at an angle B to the fluke centre line C—C of approximately 45°, i.e. negatively (up to 90°) relative to the fluke working surface 53, but the angle B could be in the range 30° to 90°. Further, a soil flow passage 65 is present between the barrier member 63 and the fluke 52 and extends laterally from the centre plane CP. The width P of the soil flow passage 65 is defined by the distance between the soil barrier 63 and the rear edge of the fluke 52 and in FIG. 4 the width P has a value of approximately 30% of the fluke length L, but this could be as high as 40% of length L.

As can be seen in FIG. 4, the barrier member 63 is located roughly adjacent the elbow of the cranked shank 54 but does not extent beyond the back edge of the shank: on the other hand, it is a significant feature that the barrier member 63 extends beyond the rear edge of the fluke 52. Indeed, in this example the member 63 is fully beyond the rear of the fluke 52. In particular in this embodiment the axial distance S of the leading edge of the member 63 from the fluke rear edge is approximately 8% L but S could be in the range 5% to 40% L. With the barrier member 63 located aft as shown, there is no part of the anchor construction directly below the working surface 64 of the member 63 so that soil deflected from the surface 64 can fall vertically without obstruction from any part of the anchor.

A pair of auxiliary fluke devices 66, 67 are formed integrally with the ends of the barrier member 63 (the transition is shown dashed in FIGS. 4 and 5), the fluke devices 66, 67 each having a working surface co-planar with the surface 64. It will be noted that the barrier member 64 extends substantially over the width of the fluke 52 but does not extend beyond the longitudinal extremity lines E—E of the fluke width, while the fluke devices 66, 67 on the other hand do extend beyond the lines E—E. The auxiliary fluke devices 66, 67 are intended to right the anchor from an inverted position on the sea bed surface by rolling when dragged thereover and also to provide a degree of dynamic stability when the anchor is buried.

The fluke angle $\theta$ of 30° is compatible with the fluke angle for non-cohesive soils for a conventional anchor. When the anchor 51 of FIGS. 4 and 6 is burying in a non-cohesive soil such as sand, the theory set out previously in the specification will apply; thus, the barrier member 63 will be orientated approximately parallel to the sand repose direction R at the rear of the anchor so that the member 63 will not substantially disrupt the sand flow and thereby inhibit optimum performance of the anchor in sand. When the anchor 51 is burying in a cohesive soil, such a soft clay or soft mud (where in a conventional anchor a fluke angle $\theta$ approaching 50° would be desired) the flow of cohesive soil reacts with the surface 64 to maintain the effective fluke angle, or alternatively maintain the forwarded projected fluke area of the anchor in the direction of relative movement of the soil. Impingement of soil on the barrier surface 64 will cause the anchor to pivot about an axis extending transversely through the cable attachment hole 60 to decrease the effective area of surface 64 but increase the effective area of fluke surface 53. The total area of the working surfaces of the barrier member 63 and the fluke devices, 66, 67 may be approximately 0.44×the area of the fluke 52. Since the barrier member 63 is set at an angle $\beta$ of 45° to the fluke, the projected area of the working surface of items 63, 66, 67 in a direction parallel to the fluke is 0.44×fluke area×sin 45° which equals 0.31×fluke area. This produces the same forward projected area of the anchor as when the angle of the main fluke 53 is increased through 18° since sin 30°=0.31. There should be no substantial build up of cohesive soil on the fluke surface 53 during movement of the anchor and soil impinging on the surface 64 can be deflected downwards and rearwardly freely.

Figure 8:
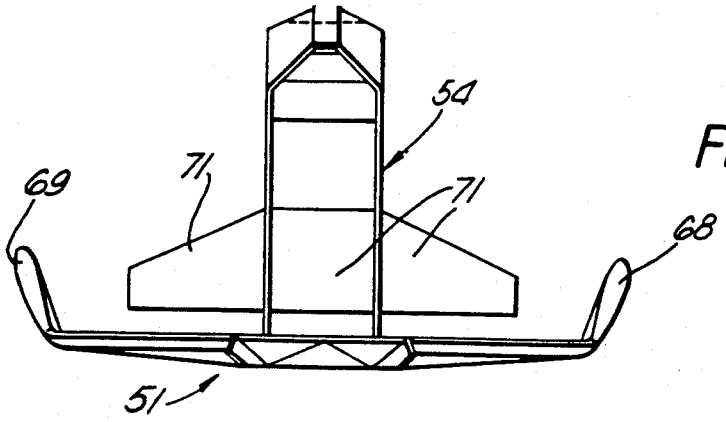
FIGS. 7,8 and 9 show a side view, front view, and plan view of a further practival embodiment of the present invention.
Figure 9:
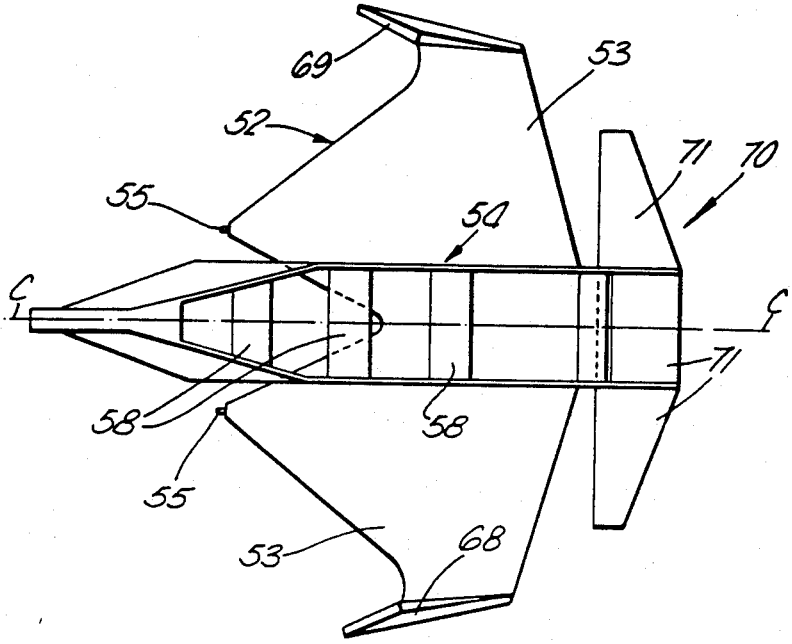
Figure 7:
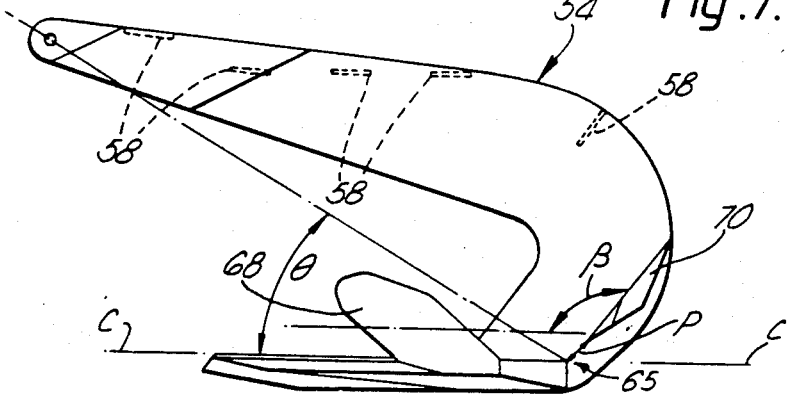

The fluke 53 in the embodiment of FIGS. 7 to 9 is generally similar to that of FIGS. 4 to 6 but includes side lugs 68, 69 in accordance with U.K. Patent 1356259; these side lugs 68, 69 serve to provide dynamic stability in the anchor and may possible also orientate the anchor upright from a inverted position. Further, the barrier member 70 in this embodiment is set at a positive angle (i.e. greater than 90°) relative to the fluke surface 53, the angle B being approximately 127° and the fluke devices 66, 67 are not present. The passage 65 in FIG. 9 has a smaller width P than that of FIG. 6 and this width may be only 5% to 20% L, 10% L is shown, i.e. the passage 65 is substantially of choke gap form. Again, the member 70 is located fully beyond the rear of fluke 52, and the shank 54 is generally similar to that of FIG. 6. Again, the member 70 does not extend beyond the back of the shank. The member 70 will function generally in accordance with the theory set out previously in the application and this will involve the build up of cohesive soil material on the working surface 71 of the member 70.

It will be understood that the negatively set barrier member 63 of FIGS. 4 to 6 could be used in place of barrier 70 in FIGS. 7 to 9 and the auxiliary fluke devices 66, 67 may or may not be present in this case. Also the barrier 70 (or 63) could be joined to upstanding lugs 68, 69 and to this end the barrier could be swept forwardly. The anchor of FIG. 10 is similar to that of FIGS. 7 to 9, but in this case two separate barrier members 70A, 70B are provided with the first set at a greater obtuse angle $\beta$ than the second. The arrangement is such that an additional soil passage 65A is provided between members 70A, 70B. Operation is generally similar to that of FIGS. 7 to 9.

Figure 12A:
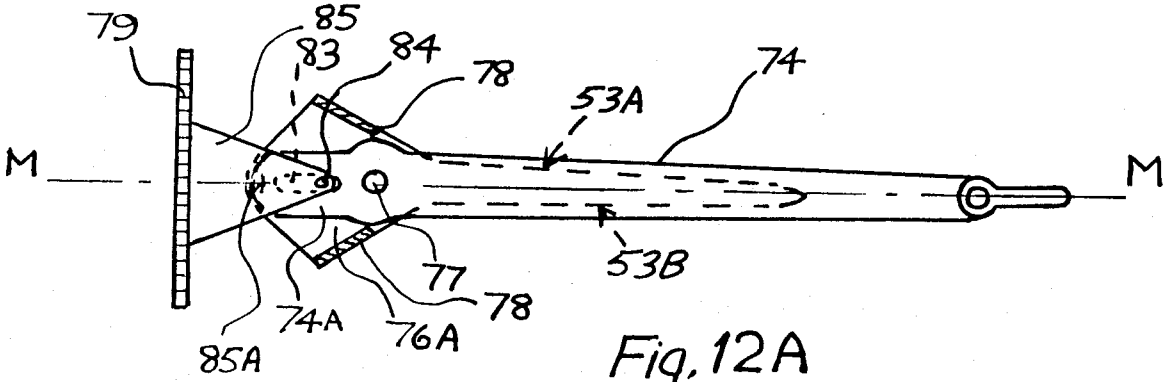

FIGS. 11, 12A and 12B show the inventive soil barrier construction of FIGS. 4 to 6 applied in a pivotal shank (i.e. Danforth) type anchor. To recap, the desirable constructional features for the barrier are (1) location beyond the rear of the fluke and when the anchor is in the vertical working burial attitude always at the upper side of the fluke for operation, and (2) no soil flow obstructing structures directly below the barrier. The anchor of FIGS. 11 to 12B is designed to have these characteristics.

The anchor of FIGS. 11 and 12 has a spaced double-fluke construction 72, 73 with the shank 74 located between the flukes 72, 73. The flukes 72, 73 include edge flanges 75 which blend into a fluke crown portion 76 having side cheeks 76A, and the shank 74 is pivotally mounted on a pin 77 in this crown portion 76. Crown stop plates 78 limit the pivoting of the shank 74 by virtue of the shank tail portion 74A abutting against one of these plates 78A as shown. Also, the lateral mid-plane M—M through the flukes 72, 73 is shown in FIG. 12A.

A soil barrier member 79 carries edge plates 80, 81 which are pivotally attached to outer edges of the flukes 72/73 by pins 82, the soil barrier member 79 extending laterally only minimally beyond the outer edges of the flukes. A mechanism is provided for appropriate pivoting of the member 79, this mechanism comprising a slot 83 in the shank tail portion 74A which engages a pin 84 carried by lug means 85 on the member 79, the lug means 85 being pin-jointed to the cheeks 76A via pins 85A which are aligned with pins 82. The shank has a part cylindrical portion 86 at the pin 77 minimising clearance at the plates 80, 81 whereby ingress of soil, e.g. sand to block the slot 83 can be substantially avoided.

In the initial unopened position of the anchor (as shown in FIG. 12A), the shank 74 is substantially parallel to the flukes 72, 73 with the pin 84 located towards the forward end of the slot 83 so that the barrier member 79 occupies the position shown in FIG. 12A i.e. at right angles to the flukes. In setting the anchor in an open operative position as shown in FIG. 12B, irrespective of which of the surfaces 53A, 53B constitute the fluke upper surfaces, pivoting of the shank 74/(anticlockwise as shown) about the pin 77 (from the position shown in FIG. 12A), for relative pivoting apart of the shank 74 and the flukes 72, 73 (as shown in FIG. 12B), causes the lug means 85 (with the barrier plate 79) to pivot about pins 85A in the opposite direction (i.e. clockwise) by virtue of the lug means 85 being joined to the shank tail 74A by the pin-and-slot connection 84, 83. One side of the slot 83 bears on the pin 84 to cause the pivoting motion of the lug means 85. The slot 83 in the shank tail 74A permits the necessary movement of the pin 84: thus as can be seen by comparing FIGS. 12A and 12B the pin 84 moves towards the rear end of the slot 83 when the shank 74 and the flukes 72, 73 are pivoted apart. Consequently the soil barrier member 79 is caused to pivot and take up a position (as shown in FIG. 12B) above and aft of the upper surface of the flukes. In this position, the barrier working surface 86 will have an angle $\beta$ of 45° to the fluke, and the barrier 79 will function similarly to the barrier 63 of FIGS. 4 to 6. Further, initially the shank and fluke will be fairly aligned (FIG. 12A), (with the barrier in the dashed position in FIG. 12B) and soil pressure reaction on the barrier 79 on initial anchor drawing will tilt the barrier 79, to force open the flukes 72, 73 and the shank 74. The side plates 80, 81 preferably provide anchor stabilising surfaces.

FIG. 12B shows a line joining the front of the flukes 72, 73 to the top edge of the barrier member 79 and this line makes an angle of 8° to 24° with the centre line M—M of the flukes. This angle range applies equally in the preceding embodiments.

It will be understood that the present invention could be applied in other forms of anchor, and modification are possible. For example the width P of the soil passage could vary along the length of the passage, or may be uniform.

I claim:

1. A fluke burial device, particularly an anchor having a burial fluke member orientated to provide a positive burial angle for digging into a bed of soil when the burial device is in the vertical working burial attitude, a cable attachment member attached to said fluke member, soil barrier means located substantially above the burial fluke member when the burial device is in said vertical working burial attitude such that a straight line from a foremost extremity of the fluke member to an upper edge of the soil barrier means lies in the range 8° to 24° to the upper surface of the fluke member, the major portion of the soil barrier means lying within the lateral extent of the fluke member, and the major portion of the soil barrier means also being located aft of the rear edge of the burial fluke member such that the rear of the soil barrier means has a horizontal separation from the rear of the burial fluke member not more than half the overall longitudinal length of the fluke member, said soil barrier surface having an area less than the upper surface area of the fluke member, and passage means associated with said soil barrier means to permit escape of non-cohesive soil passing over the fluke member.

2. A device according to claim 1, wherein the soil barrier means lie completely aft of the fluke member.

3. A device according to claim 2, wherein the front edge of the barrier means is spaced aft of the rear edge of fluke member 5 percent to 40 percent of the overall longitudinal length of the fluke member.

4. A device according to claim 2 wherein the soil barrier means are carried by a portion of the cable attachment member which extends backwardly from the rear of the fluke member.

5. A device according to claim 1, wherein the soil passage means have a width less than twenty percent of the overall longitudinal length of the fluke member and define choke gap means facilitating an accumulation of cohesive soil over the fluke member.

6. A device according to claim 5, wherein said width is not greater than 10 percent of the overall longitudinal length of the fluke member.

7. A device according to claim 1, wherein the barrier means lies at an angle to the fluke upper surface in the range 20° to 130° measured in a fore-and-aft vertical plane.

8. A device according to claim 1, wherein the soil barrier means comprises a plurality of transversely extending barrier members located so that a soil passage is present between two successive soil barriers members.

9. A device according to claim 8 wherein a following barrier member is located aft and above a preceding barrier member, the preceding barrier member being inclined at a greater obtuse angle to the fluke member than the following barrier member.

10. A device according to claim 1 wherein the cable attachment is pivotally attached to the fluke member for relative pivoting apart of these members and wherein said soil barrier means is pivotally mounted about an axis transverse to the centre line of the fluke member and a pivoting mechanism is coupled to said soil barrier means and includes a linkage which is actuable on relative pivoting apart of the fluke member and the cable attachment member to pivot the soil barrier means to an operating position inclined to the fluke member whereat a straight line from edge of the fluke member to an upper edge of the inclined soil barrier means lies in said range 8° to 24° to the upper surface of the fluke member.

11. A device according to claim 10 wherein said pivoting mechanism comprises a pin-and-slot arrangement between the soil barrier means and the cable attachment member.

12. A device according to claim 10, wherein the soil barrier means includes outer edge plates which are freely pinned to outer edge portions of the fluke member to enable pivoting of the barrier means.

13. A device according to claim 10, wherein the barrier means present an angle of between 30° to 70° to the centre line of the fluke member when the anchor device is in the operative position.

14. A device according to claim 1, wherein the area of working surface of the soil barrier means lies within the range 10 percent to 65 percent of the upper surface area of the fluke member.

15. A fluke burial device, particularly an anchor having a burial fluke member orientated to provide a positive burial angle for digging into a bed of soil when the burial device is in the vertical working burial attitude, a cable attachment member attached to said fluke member, soil barrier means located substantially above the burial fluke member when the burial device is in said vertical working burial attitude, the major portion of the soil barrier means lying within the lateral extent of the fluke member, and the major portion of the soil barrier means also being located aft of the rear edge of the burial fluke member such that the rear of the soil barrier means has a horizontal separation from the rear of the burial fluke member not more than half the overall longitudinal length of the fluke member, said soil barrier means including at least one soil barrier surface which is inclined with a forwardly opening acute angle relative to said burial fluke member, said soil barrier surface having an area less than the upper surface area of the fluke member, and soil passage means associated with said soil barrier means to permit escape of non-cohesive soil passing over the fluke member.

16. A device according to claim 15, wherein the width of said soil passage means is not greater than forty percent (40%) of the overall longitudinal length of the fluke member.

17. A device according to claim 15 wherein the soil passage means has a width less than twenty percent (20%) of the overall longitudinal length of the fluke member and define choke gap means facilitating an accumulation of cohesive soil over the fluke member.

18. A device according to claim 11, wherein said width is not greater than 10 percent of the overall longitudinal length of the fluke member.

19. A device according to claim 15, wherein the front edge of the barrier means is spaced aft of the rear edge of fluke member 5 percent to 40 percent of the overall longitudinal length of the fluke member.

20. A device according to claim 15 wherein said acute angle lies in the range of 30° to 50°.

21. A device according to claim 15, wherein the soil barrier means are carried by a portion of the cable attachment member which extends backwardly from the rear of the fluke member.

22. A device according to claim 15, wherein the area of the working surface of the soil barrier means lies within the range 10 percent to 65 per cent of the upper surface area of the fluke member.

* * * * *